US010704359B2

(12) United States Patent
Fripp et al.

(10) Patent No.: US 10,704,359 B2
(45) Date of Patent: Jul. 7, 2020

(54) FLOW CONTROL SYSTEM FOR USE IN A SUBTERRANEAN WELL

(71) Applicant: Halliburton Energy Services, Inc., Houston, TX (US)

(72) Inventors: Michael L. Fripp, Carrollton, TX (US); Stephen M. Greci, Little Elm, TX (US); Thomas J. Frosell, Irving, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 87 days.

(21) Appl. No.: 15/767,634

(22) PCT Filed: Oct. 17, 2017

(86) PCT No.: PCT/US2017/057011

§ 371 (c)(1),
(2) Date: Apr. 11, 2018

(87) PCT Pub. No.: WO2018/093516

PCT Pub. Date: May 24, 2018

(65) Prior Publication Data

US 2019/0063182 A1 Feb. 28, 2019

Related U.S. Application Data

(60) Provisional application No. 62/424,999, filed on Nov. 21, 2016.

(51) Int. Cl.
*E21B 34/08* (2006.01)
*E21B 43/12* (2006.01)

(52) U.S. Cl.
CPC ..... *E21B 34/08* (2013.01); *E21B 43/12* (2013.01); *E21B 2200/04* (2020.05)

(58) Field of Classification Search
CPC .... E21B 34/08; E21B 43/12; E21B 2034/002; E21B 43/32; E21B 34/06
See application file for complete search history.

(56) References Cited

U.S. PATENT DOCUMENTS

| | | | | |
|---|---|---|---|---|
| 3,363,642 | A | 1/1968 | Grayson | |
| 8,739,880 | B2 | 6/2014 | Dykstra et al. | |
| 9,453,395 | B2 | 9/2016 | Fripp et al. | |
| 2013/0161024 | A1 | 6/2013 | Greci | |
| 2014/0041731 | A1 | 2/2014 | Fripp et al. | |
| 2015/0308226 | A1* | 10/2015 | Killie | E21B 34/08 166/373 |
| 2016/0160616 | A1 | 6/2016 | Moen et al. | |

FOREIGN PATENT DOCUMENTS

| | | |
|---|---|---|
| WO | 200824645 | 2/2008 |

OTHER PUBLICATIONS

International Search Report and Written Opinion of PCT Application No. PCT/US2017/057011 dated Jan. 31, 2018: pp. 1-15.

* cited by examiner

*Primary Examiner* — Brad Harcourt
(74) *Attorney, Agent, or Firm* — Chamberlain Hrdlicka

(57) ABSTRACT

A flow control system for use in a subterranean well includes a flow chamber comprising an inlet and an outlet that is configured to receive a fluid, and a flow restriction member positioned and movable within the flow chamber. The flow restriction member is configured to restrict fluid flow from the inlet to the outlet of the flow chamber based upon a density of the fluid.

17 Claims, 7 Drawing Sheets

FLOW CONTROL SYSTEM FOR USE IN A SUBTERRANEAN WELL

BACKGROUND

This section is intended to provide relevant contextual information to facilitate a better understanding of the various aspects of the described embodiments. Accordingly, it should be understood that these statements are to be read in this light and not as admissions of prior art.

This disclosure relates generally to equipment utilized and operations performed in conjunction with a subterranean well and, in an example described below, more particularly provides a flow control device or a flow control system.

In a hydrocarbon production well, it may be beneficial to be able to regulate flow of fluids from an earth formation into a wellbore, from the wellbore into the formation, and within the wellbore. A variety of purposes may be served by such regulation, including prevention of water or gas coning, minimizing sand production, minimizing water and/or gas production, maximizing oil production, balancing production among zones, transmitting signals, etc.

Therefore, it will be appreciated that advancements in the art of variably restricting or controlling fluid flow in a well would be desirable in the circumstances mentioned above, and such advancements would also be beneficial in a wide variety of other circumstances.

BRIEF DESCRIPTION OF THE DRAWINGS

Illustrative embodiments of the present disclosure are described in detail below with reference to the attached drawing figures, which are incorporated by reference herein and wherein.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

Oil and gas hydrocarbons are naturally occurring in some subterranean formations. A subterranean formation containing oil or gas may be referred to as a reservoir, in which a reservoir may be located under land or off shore. Reservoirs are typically located in the range of a few hundred feet (shallow reservoirs) to a few tens of thousands of feet (ultra-deep reservoirs). To produce oil or gas, a wellbore is drilled into a reservoir or adjacent to a reservoir.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

A portion of a wellbore may be an open-hole or cased-hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

Figure 1:
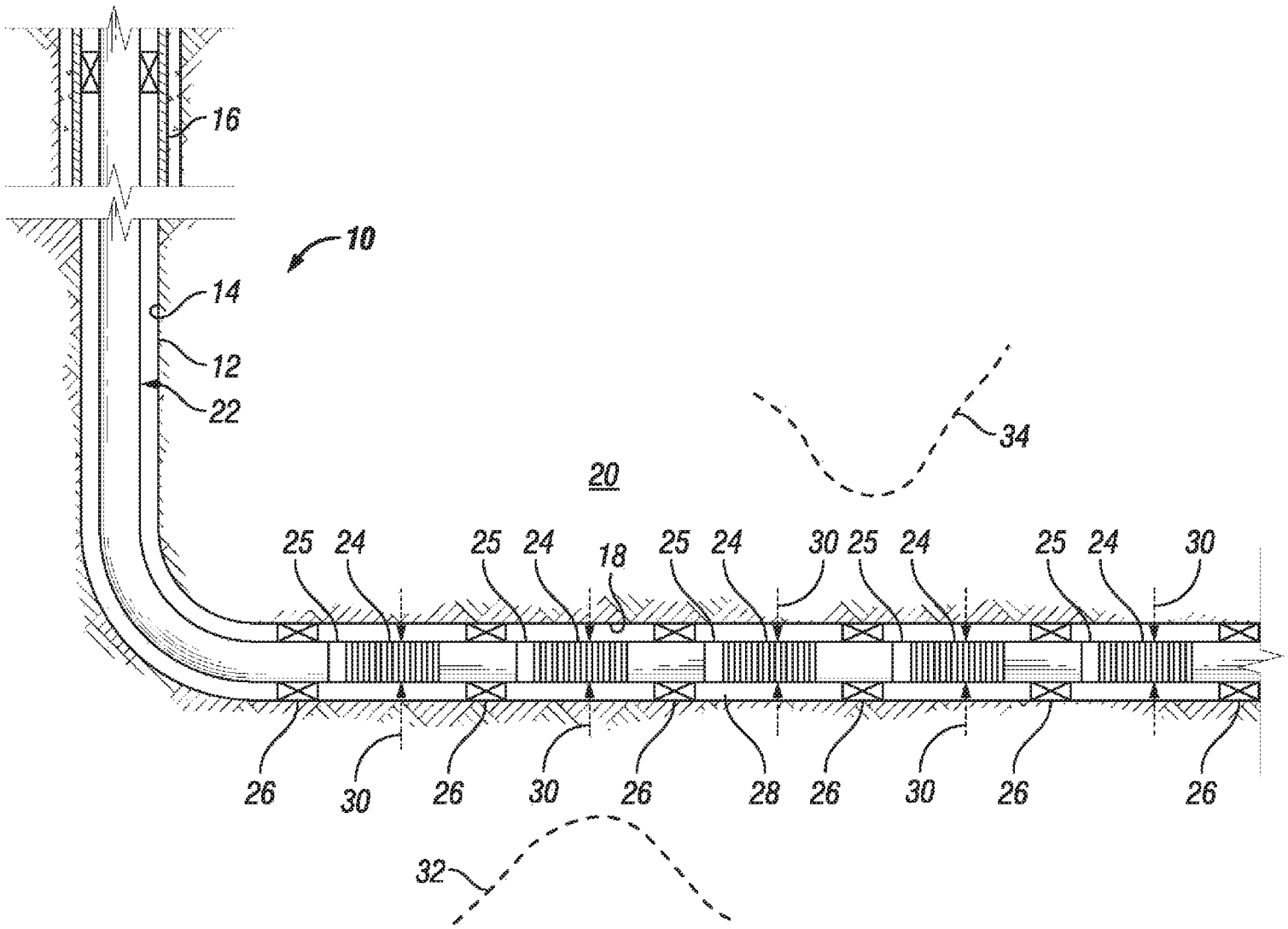
FIG. 1 shows schematic view of a well system including a flow control system in accordance with one or more embodiments of the present disclosure.

Turning now to the present figures, FIG. 1 shows a well system 10 that can embody principles of the present disclosure. As depicted in FIG. 1, a wellbore 12 has a generally vertical uncased section 14 extending downwardly from casing 16, as well as a generally horizontal uncased section 18 extending through an earth formation 20.

A tubular string 22 (such as a production tubing string) is installed in the wellbore 12. Interconnected in the tubular string 22 are multiple well screens 24, flow control systems 25, and packers 26. The packers 26 seal off an annulus 28 formed radially between the tubular string 22 and the wellbore section 18. In this manner, fluids 30 may be produced from multiple intervals or zones of the formation 20 via isolated portions of the annulus 28 between adjacent pairs of the packers 26. A well screen 24 and a flow control system 25 are interconnected in the tubular string 22 are positioned between each adjacent pair of the packers 26. The well screen 24 filters the fluids 30 flowing into the tubular string 22 from the annulus 28. The flow control system 25 variably restricts flow of the fluids 30 into the tubular string 22, based on certain characteristics of the fluids.

It should be noted that the well system 10 is illustrated in the drawings and is described herein as merely one example of a wide variety of well systems in which the principles of this disclosure can be utilized. It should be clearly understood that the principles of this disclosure are not limited at all to any of the details of the well system 10, or components thereof, depicted in the drawings or described herein. For example, it is not necessary for fluids 30 to be only produced from the formation 20 as, in other examples, fluids could be injected into a formation, fluids could be both injected into and produced from a formation, etc. Further, it is not necessary for one each of the well screen 24 and flow control system 25 to be positioned between each adjacent pair of the packers 26. It is not necessary for a single flow control system 25 to be used in conjunction with a single well screen 24. Any number, arrangement and/or combination of these components may be used.

It is not necessary for any flow control system 25 to be used with a well screen 24. For example, in injection operations, the injected fluid could be flowed through a flow control system 25, without also flowing through a well screen 24. Further, it is not necessary for the well screens 24, flow control systems 25, packers 26 or any other components of the tubular string 22 to be positioned in uncased sections 14, 18 of the wellbore 12. Any section of the wellbore 12 may be cased or uncased, and any portion of the tubular string 22 may be positioned in an uncased or cased section of the wellbore, in keeping with the principles of this disclosure.

It should be clearly understood, therefore, that this disclosure describes how to make and use certain examples, but the principles of the disclosure are not limited to any details of those examples. Instead, those principles can be applied to a variety of other examples using the knowledge obtained from this disclosure.

It will be appreciated by those skilled in the art that it would be beneficial to be able to regulate flow of the fluids 30 into the tubular string 22 from each zone of the formation 20, for example, to prevent water coning 32 or gas coning 34 in the formation. Other uses for flow regulation in a well include, but are not limited to, balancing production from (or injection into) multiple zones, minimizing production or injection of undesired fluids, maximizing production or injection of desired fluids, etc.

Figure 2:
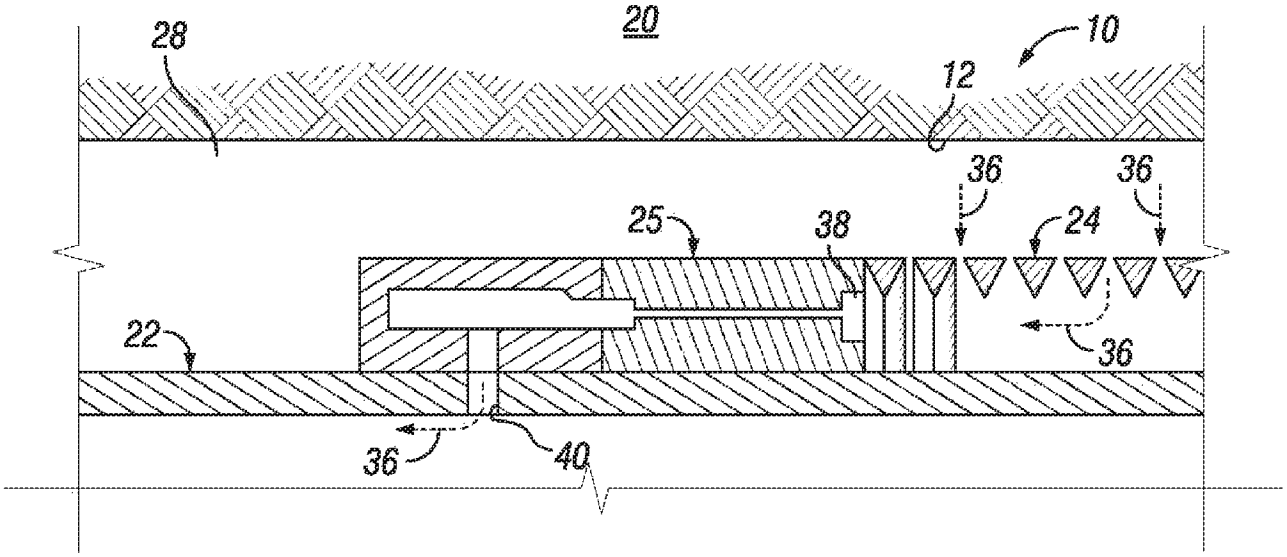
FIG. 2 shows schematic view of a flow control system in accordance with one or more embodiments of the present disclosure.

Referring additionally now to FIG. 2, an enlarged scale cross-sectional view of one of the flow control systems 25 and a portion of one of the well screens 24 is representatively illustrated. In this example, a fluid composition 36 (which can include one or more fluids, such as oil and water, liquid water and steam, oil and gas, gas and water, oil, water and gas, etc.) flows into the well screen 24, is thereby filtered, and then flows into an inlet 38 of the flow control system 25. A fluid composition can include one or more undesired or desired fluids. Both steam and water can be combined in a fluid composition. As another example, oil, water and/or gas can be combined in a fluid composition.

Flow of the fluid composition 36 through the flow control system 25 is resisted based on one or more characteristics (such as viscosity, velocity, density, etc.) of the fluid composition. In the present disclosure, fluid flow is resisted or restricted particularly based upon the density of the fluid. The fluid composition 36 is then discharged from the flow control system 25 to an interior of the tubular string 22 via an outlet 40.

Although the well screen 24 depicted in FIG. 2 is of the type known to those skilled in the art as a wire-wrapped well screen, any other types or combinations of well screens (such as sintered, expanded, pre-packed, wire mesh, slotted liner, etc.) may be used in other examples. Additional components (such as shrouds, shunt tubes, lines, instrumentation, sensors, inflow control devices, etc.) may also be used, if desired.

The flow control system 25 is depicted in simplified form in FIG. 2, but in a preferred example the system can include various passages and devices for performing various functions, as described more fully below. In addition, the system 25 preferably at least partially extends circumferentially about the tubular string 22, and/or the system may be formed in a wall of a tubular structure interconnected as part of the tubular string.

In other examples, the system 25 may not extend circumferentially about a tubular string or be formed in a wall of a tubular structure. For example, the system 25 could be formed in a flat structure, etc. The system 25 could be in a separate housing that is attached to the tubular string 22, or it could be oriented so that the axis of the outlet 40 is parallel to the axis of the tubular string. The system 25 could be on a logging string or attached to a device that is not tubular in shape. Any orientation or configuration of the system 25 may be used in keeping with the principles of this disclosure.

Examples of the flow control systems 25 described more fully below can provide these benefits by increasing resistance to flow if a fluid velocity increases beyond a selected level (e.g., to thereby balance flow among zones, prevent water or gas coning, etc.), or increasing resistance to flow if a fluid viscosity decreases below a selected level (e.g., to thereby restrict flow of an undesired fluid, such as water or gas, in an oil producing well).

Whether a fluid is a desired or an undesired fluid depends on the purpose of the production or injection operation being conducted. For example, if it is desired to produce oil from a well, but not to produce water or gas, then oil is a desired fluid and water and gas are undesired fluids.

Note that, at downhole temperatures and pressures, hydrocarbon gas can actually be completely or partially in liquid phase. Thus, it should be understood that when the term "gas" is used herein, supercritical, liquid and/or gaseous phases are included within the scope of that term.

It may be desired to produce or restrict production of fluid through a flow control device or system (e.g., inflow control device ("ICD")) based upon the density of the fluid. For example, it may be desired to produce gas (e.g., a fluid having a relatively lower density) while restricting or preventing the production of water (e.g., a fluid having a relatively higher density, at least compared to gas). An autonomous flow control device or system (e.g., autonomous ICD ("AICD")) may not be able to correctly distinguish and limit the production of the water versus the gas because the water and gas kinematic viscosities may be relatively close or similar to each other.

In one or more embodiment, the present disclosure may use the difference in density between one or more different types of fluid (e.g., gas and liquid) to distinguish between the type of fluid flowing through the flow control system. The flow control system may then allow or restrict the flow of fluid through the system based upon the density. For example, the present disclosure may use or apply a centripetal force (e.g., artificial gravity) to one or more flow restriction members such that the flow control device or system may not be sensitive to orientation (e.g., capable of operation independent of gravity). A flow restriction member may comprise a ball (e.g., sphere) or other shape positioned within a flow chamber of the flow control system. The flow chamber may have a vortex shape and/or may be capable of inducing a vortex fluid flow within the flow chamber. The vortex in the flow chamber may create large enough centripetal forces to enhance the density effects from the flow restriction member. The flow restriction member is able to move radially with respect to an axis of the flow chamber based upon a density of the fluid to restrict fluid flow from the inlet to the outlet of the flow chamber.

Figure 3:
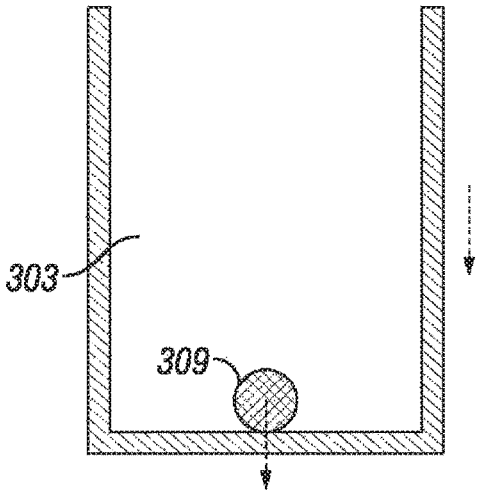
FIG. 3 shows a schematic view of a flow restriction member in a relatively lower density fluid in accordance with the present disclosure.
Figure 4:
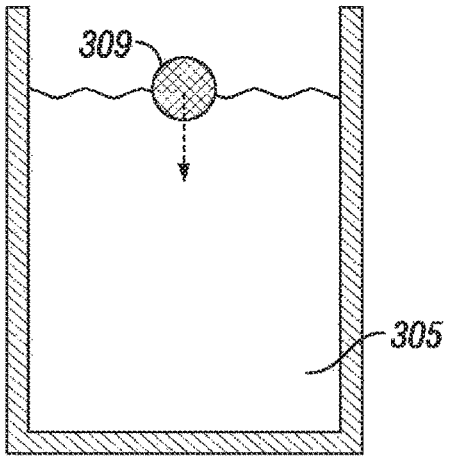
FIG. 4 shows a schematic view of a flow restriction member in a relatively higher density fluid in accordance with the present disclosure.

With respect to FIGS. 3 and 4, multiple schematic views of a flow restriction member 309 in accordance with one or more embodiments of the present disclosure is shown. The flow restriction member 309 may be a ball or sphere, as shown, may be a cylinder, may be one or more segments coupled to each other (discussed more below), and/or may have any other shape known in the art. As shown with respect to FIGS. 3 and 4, the flow restriction member 309 may be formed to have a density such that the member 309 sinks in a fluid 303 (e.g., gas) having a lower density than the member 309 and floats in a fluid 305 (e.g., water or liquid) having a higher density than the member 309. Thus, as the fluids 303 and 305 have different densities, and the member 309 may have a density selected such that the member 309 is able to sink in the fluid 303 in FIG. 3 and float (or be neutrally buoyant) in the fluid 305 in FIG. 4.

With respect to FIG. 4, the buoyancy force generated by or upon the member 309 may be relatively small (e.g., less than 1 $g_n$ (gravitational-force)) because the difference in density between the fluid 305 and the member 309 is relatively small. Accordingly, a flow restriction member 309 in accordance with the present disclosure may be formed from or include a syntactic material (e.g., syntactic foam, such as a composite material that includes hollow or non-hollow spheres in a metal, polymer, or ceramic matrix), a metallic material, a glass material, a ceramic material, an epoxy-based material, a plastic material, and/or any other material that may be appreciated in the art.

Figure 5:
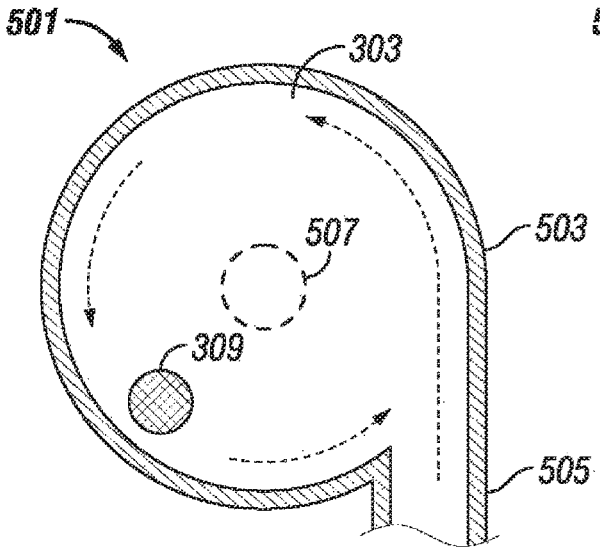
FIG. 5 shows a schematic view of a flow control system in accordance with one or more embodiments of the present disclosure.
Figure 6:
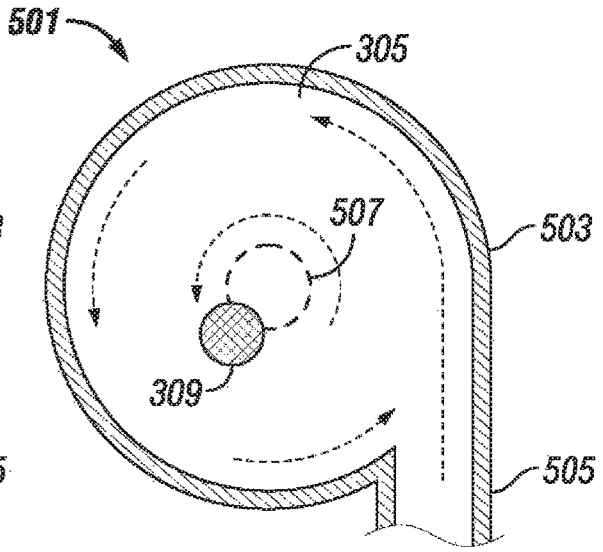
FIG. 6 shows a schematic view of a flow control system in accordance with one or more embodiments of the present disclosure.
Figure 7:
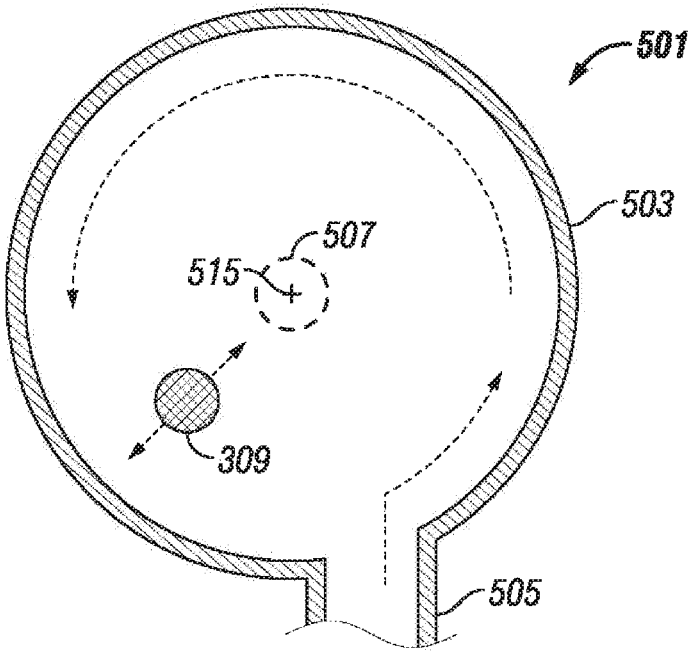
FIG. 7 shows a schematic view of a flow control system in accordance with one or more embodiments of the present disclosure.

Referring now to FIGS. 5-7, schematic views of a flow control system 501 in accordance with one or more embodiments of the present disclosure are shown. The flow control system 501 includes a flow chamber 503 with one or more inlets 505 and one or more outlets 507. For purposes of simplicity, the inlet 505 and the outlet 507 are shown as ports and function as an inlet or an outlet depending on the direction of fluid flow through the flow control system 501. Accordingly, in another embodiment, if fluid flow is reversed through the system 501, the inlet 505 may function as an outlet, and the outlet 507 may function as an inlet. One or more flow restriction members 309 may be positioned within the flow chamber 503 and may be selectively movable within the flow chamber 503. In particular, the flow restriction member 309 is movable within the flow chamber 503 to restrict, resist, or prevent fluid flow through the flow chamber 503 based upon the density of the fluid within the flow chamber 503.

The flow chamber 503 may be formed to have a circular or semi-circular cross-sectional shape to induce a vortex in the flow of fluid through the flow chamber 503. The flow chamber 503, thus, may have an axis 515 defined therethrough, shown in FIG. 7, such that the fluid flow vortex rotates about the axis 515, although the axis of the flow chamber 503 does not necessarily need to align with the outlet 507. FIG. 5 shows an example of having the fluid 303 (e.g., gas) with a lower density than the flow restriction member 309 flowing through the flow chamber 503. FIG. 6 shows an example of having the fluid 305 (e.g., water or liquid) with a higher density than the flow restriction member 309 flowing through the flow chamber 503.

Placing the member 309 in a vortex of the fluid flow amplifies the forces applied to the member 309. As the fluid is rotating in the fluid flow vortex in FIGS. 5-7, this rotation imparts a centripetal force on the member 309, and on the fluids 303 and 305. The amplitude of the centripetal force depends on the rotational rate of the fluids 303 and 305, and also depends on the mass or density of the member 309 and the fluids 303 and 305. The centripetal force increases the buoyancy force from the 1 $g_n$ to over 10 $g_n$ or more.

In FIG. 5, the fluid 303 has a lower density than the member 309, so the centrifugal forces acting on the fluid 303 will be less than the centrifugal forces acting on the member 309. As a result, the member 309 will react to a stronger buoyancy force than 1 $g_n$ and will move away from the outlet 507. In FIG. 6, the fluid 303 has a higher density than the member 309, so the buoyancy force will move the member 309 towards the outlet 507. As shown between FIGS. 5 and 6, this results in the member 309 shifting in radial position depending on the type and density of the fluids 303 and 305.

In FIG. 5, for the lower density fluid 303 (e.g., gas), the member 309 will move or rotate about the axis 515 further radially outward, whereas comparatively in FIG. 6, for the higher density fluid 305 (e.g., liquid), the member 309 will move or rotate about the axis 515 further radially inward. Alternatively phrased, the member 309 will move radially outward if the member 309 has a higher density than a fluid, and the member 309 will move radially inward if the member 309 has a lower density than a fluid. This effect can be used by the flow control system 501 to selectively produce or restrict the flow of fluid having different densities, such as to produce gas rather than water, to produce oil rather than water, or vice-versa. For example, in FIG. 5, the flow control system 501 selectively enables the lower density fluid 303 to flow from the inlet 505 to the outlet 507 whereas in FIG. 6, the flow control system 501 selectively resists or restricts the higher density fluid 305 to flow from the inlet 505 to the outlet 507 with flow restriction member 309 obstructing, at least partially, the outlet 507. The flow control system 501, thus, may operate as a density-based AICD.

In one or more embodiments, a flow control system in accordance with the present disclosure may not be sensitive to orientation, such as when positioned within a tubular string and in a well. For example, the flow control system may be capable of operation independent of orientation and gravitational forces acting upon the components of the flow control system. The centripetal force or acceleration for the fluid flow is radially outward within the flow chamber of the flow control system, and as shown previously, this force may be much larger than the gravitational force, as long as minimal fluid flow is present through the flow control system. As a result, the orientation of a flow control system in accordance with the present disclosure may be irrelevant.

In one or more embodiments, the inlet or entrance to the flow chamber may be used to create or induce rotation and a vortex in the fluid flow through the flow control system. Accordingly, to facilitate this fluid flow, the inlet may be tangential, such as at least partially or completely tangential, to a wall of the flow chamber. For example, in FIGS. 5 and 6, the inlet 505 is shown as formed tangential with respect to the flow chamber 503. Additionally, in one or more embodiments, multiple inlets may be used to make facilitate fluid flow into the flow chamber and through the flow control system. Further, one or more vanes or guides may be positioned or created within the flow chamber to selectively guide and control fluid flow through the flow chamber.

Figure 8:
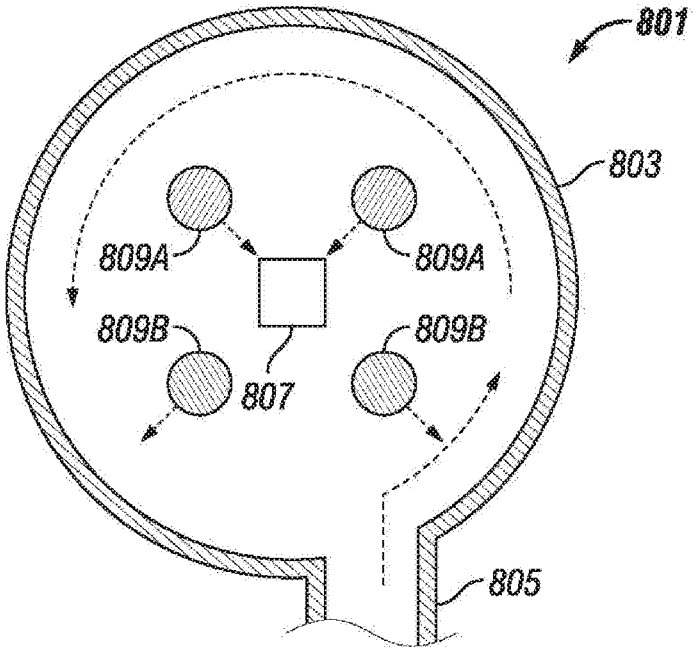
FIG. 8 shows a schematic view of a flow control system in accordance with one or more embodiments of the present disclosure.

Referring now to FIG. 8, a schematic view of a flow control system 801 in accordance with one or more embodiments of the present disclosure is shown. The flow control system 801 includes an inlet 805 and an outlet 807 to enable fluid flow through a flow chamber 803. Further, in this embodiment, multiple flow restriction members 809 are included within the flow chamber 803 of the system 801. The flow restriction members 809 may have different densities, such as having lighter flow restriction members 809A and heavier (e.g., denser) flow restrictions member 809B, comparatively. As such, the flow restriction members 809 may be able to vary the restriction against the fluid flow through the outlet 807 as the density of the fluid within the flow control system 801.

For example, when a relatively low density fluid flows through the flow control system 801, none of the members 809A or 809B may restrict the flow of the low density fluid through the outlet 807 of the chamber 803. When a relatively high density fluid flows through the flow control system 801, all of the members 809A and 809B may restrict the flow of the high density fluid through the outlet 807 of the chamber 803. When a relatively medium density fluid (i.e., a density between the low density fluid and the high density fluid) flows through the flow control system 801, the lighter flow restriction members 809A may accumulate and rotate closer to the outlet 807 to restrict fluid flow, but the heavier flow restriction members 809B may still rotate further out from the outlet 807 to not substantially restrict fluid flow. Thus, the flow restriction members 809 may be able to vary the restriction against the fluid flow through the outlet 807 as the density of the fluid within the flow control system 801. Further, by including multiple flow restriction members 809 within the chamber 803, the members 809 may be able to interact and contact each other to prevent any type of orbiting behavior of the members 809, such as when a member 809 rotates around the outlet 807 but not moving over the outlet 807 to restrict fluid flow. Additionally, the chamber 803 may have multiple outlets 807 (such as with a mesh) so that the occlusion of the outlet 807 by the members 809 will progressively restrict flow.

Figure 9:
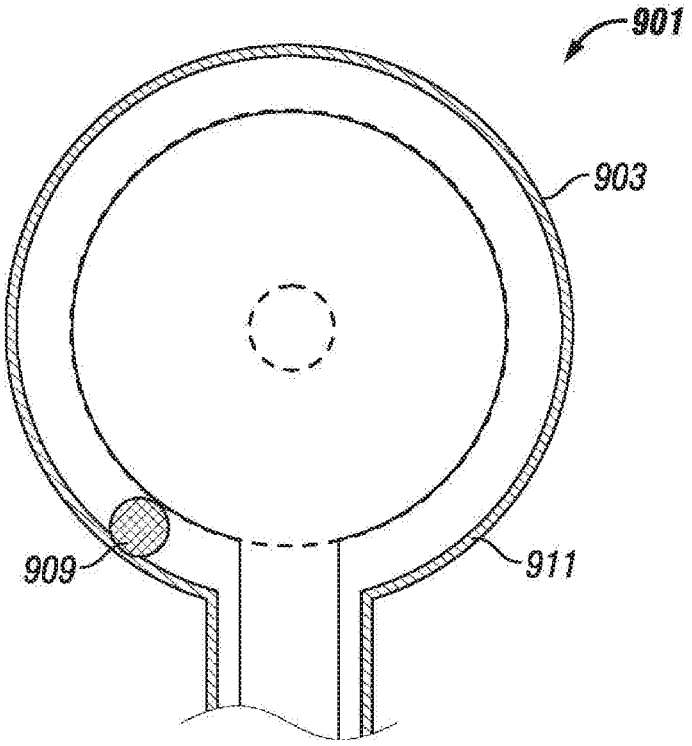
FIG. 9 shows a schematic view of a flow control system in accordance with one or more embodiments of the present disclosure.

Referring now to FIG. 9, a schematic view of a flow control system 901 including a degradable material 911 in accordance with one or more embodiments of the present disclosure is shown. A degradable material in accordance with the present disclosure may be defined as a material that is erodible and/or dissolvable. A flow restriction member 909 may be constrained, at least partially or initially, within the degradable material 911 in a flow chamber 903. For example, to prevent the member 909 from prematurely restricting fluid flow through the flow control system 901, such as during installation, stimulation, or early production of a wellbore, the flow restriction member 909 may be restricted in movement within the flow chamber 909 with the material 911. For example, it may be desired to not restrain the initial production from a wellbore, as this production may be mostly water. As fluid flows through the flow control system 901, this fluid flow may begin to degrade that material 911 to release the member 909. This will allow the member 909 to then selectively restrain fluid flow through the flow control system 901 after the initial wellbore production.

In one embodiment, the member 909 is restricted in movement in the flow chamber 903 by the material 911 until the well has been in production for several months. For example, the material 911 may be a dissolvable material, such as a dissolvable metal, plastic, rubber, ceramic, glass, and/or any other dissolvable material known in the art, and an acid or a solvent may be introduced into the flow chamber 903 to dissolve the material 911 and release the member 909. In another embodiment, the material 911 may be an erodible material, in which the erodible material is removed by the rotation and flow of fluid through the flow chamber 903 and against the material 911.

In another embodiment, the degradable material 911 may hold, contain, or restrict multiple members 909. For example, multiple members 909 may be positioned within the degradable material 911 to release the members 909 across different intervals of time. The degradable material 911 may be formed as multiple layers, and/or may be formed as different types of degradable materials 911, such that the members 909 are released sequentially over a period of days, weeks, months, or years, into the flow chamber 903. Thus, a new member 909 is released every predetermined time period (e.g., month or two). This approach would refresh the members 909 that may be damaged by rubbing against the wall or surfaces of the flow chamber 903.

Figure 10:
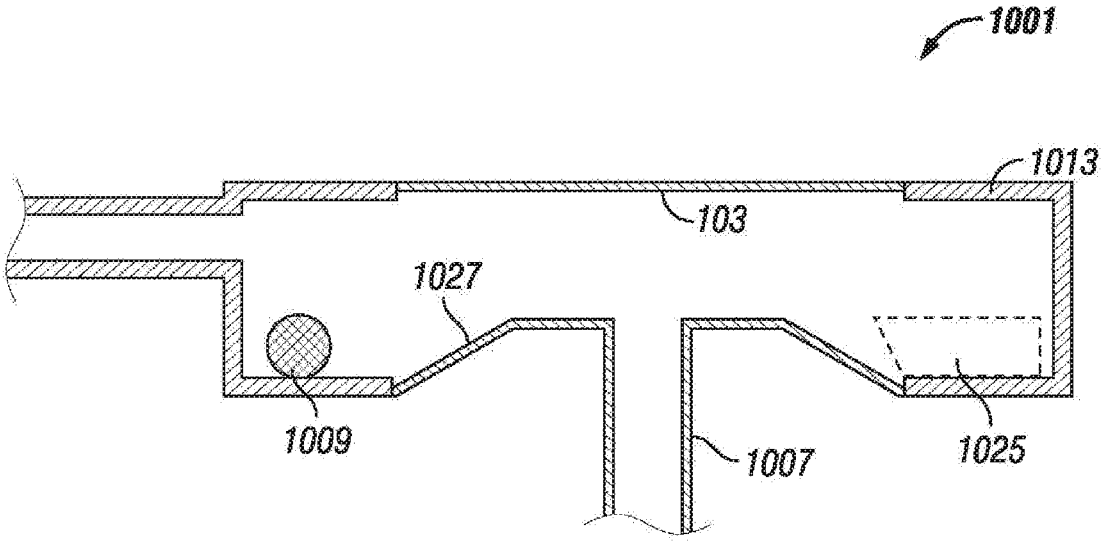
FIG. 10 shows a schematic cross-sectional view of a flow control system in accordance with one or more embodiments of the present disclosure.

Referring now to FIG. 10, a schematic cross-sectional view of a flow control system 1001 including a low friction layer 1013 in accordance with one or more embodiments of the present disclosure is shown. The low friction layer 1013 may be formed on, deposited on, or otherwise positioned on an inner surface or outer edge of the flow chamber 1003. The low friction layer 1013 may provide a relatively lower frictional force against the flow restriction member 1009 and/or have a lower coefficient of friction than the inner surface of the flow chamber 1003 than other portions or surfaces within the flow chamber 1003. The layer 1013 may be able to reduce the abrasion of the member 1009 against the inner surface of the flow chamber 1003.

Further, as shown in FIG. 10, the flow chamber 1003 may have a variable profile. For example, the profile of the flow chamber may be varied to create a region 1025 of slower fluid flow, which may also reduce the abrasion of the member 1009 against the inner surface of the flow chamber 1003. In this embodiment, an inner surface 1027 of the flow chamber 1003 adjacent the outlet 1007 may be raised to create the region 1025 for relatively slower fluid flow. This raised surface 1027 may also facilitate or ensure that the flow restriction member 1009 does not land or restrict fluid flow through the outlet 1007 when undesired or during a period of no fluid flow.

Figure 11:
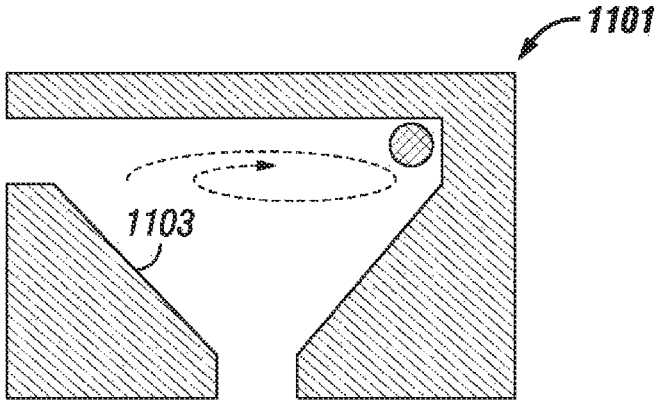
FIG. 11 shows a schematic cross-sectional view of a flow control system in accordance with one or more embodiments of the present disclosure.
Figure 12:
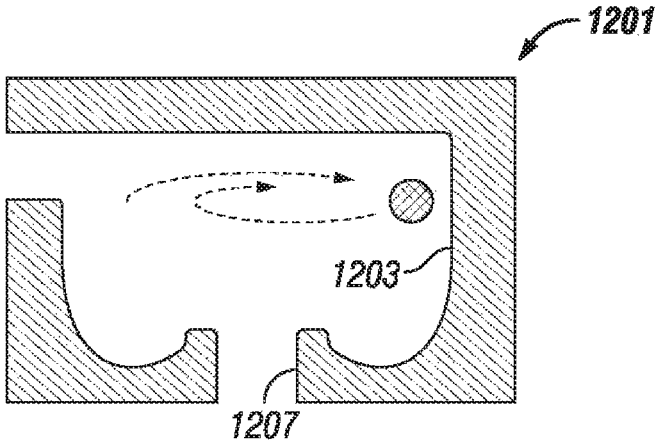
FIG. 12 shows a schematic cross-sectional view of a flow control system in accordance with one or more embodiments of the present disclosure.

FIGS. 11 and 12 show additional embodiments in which the flow chamber of a flow control system may have a variable profile. In FIG. 11, the flow chamber 1103 may be tapered such that the profile is conical or frusto-conical. Further, in FIG. 12, the flow chamber 1203 may be concave, as opposed to tapered, and the profile or inner surface of the flow chamber 1203 adjacent the outlet 1207 may be raised, such as to create a region for relatively slower fluid flow or create a ledge adjacent the outlet 1207 to prevent the ball from landing on the outlet 1207.

Figure 13:
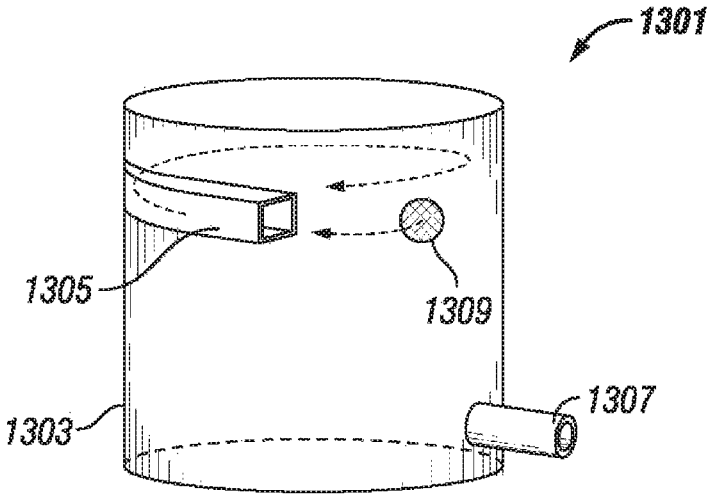
FIG. 13 shows a schematic perspective view of a flow control system in accordance with one or more embodiments of the present disclosure.

Referring now to FIG. 13, a perspective schematic view of a flow control system 1301 in accordance with one or more embodiments of the present disclosure is shown. In this embodiment, the flow control system 1301 includes a flow chamber 1303 with an inlet 1305 and an outlet 1307. The outlet 1307, however, in this embodiment, may be radially outward from the center or the axis of the flow chamber 1303. For example, in the previous embodiments, the outlet may be centrally located or position in alignment with the axis of the flow chamber. The outlet 1307 in FIG. 13, though, is positioned radially outward from an axis of the flow chamber 1303, such as formed on the radial exterior and within a wall that defines the flow chamber 1303. In such an embodiment, the flow restriction member 1309 may move radially outward to restrict fluid flow through the outlet 1307. In such an embodiment, the flow restriction member 1309 may be used to restrict production or fluid flow of a low-density fluid and allow production of a high-density fluid through the flow control system 1301. For example, in an embodiment in which gas or oil (e.g., a low-density fluid) and water (e.g., a high-density fluid) are introduced into the flow control system 1301, the flow restriction member 1309 may be used to restrict the flow or production of gas and allow the production of water through the flow control system 1301.

As discussed above, the flow restriction member may include any shape known in the art, or may be formed from one or more segments. Accordingly FIGS. 14 A and 14B show perspective schematic views of a flow control system 1401 in which the flow restriction member 1409 is formed from a plurality of segments 1421. The flow restriction member 1409 may be rotatable within the flow chamber 1403, such as rotatable about the outlet 1407. Further, the segments 1421 may be coupled to each other (e.g., movably coupled to each other), such as through a connector, to connect the segments 1421 to each other. The connector, for example, may include a spring 1423, or some other type of biasing mechanism, to enable the segments 1421 to move with respect to each other.

Figure 14A:
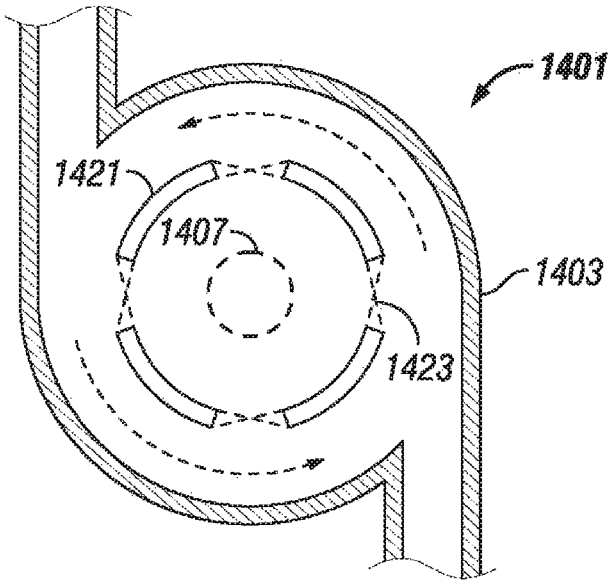
FIGS. 14A and 14B show schematic views of a flow control system in accordance with one or more embodiments of the present disclosure.
Figure 14B:
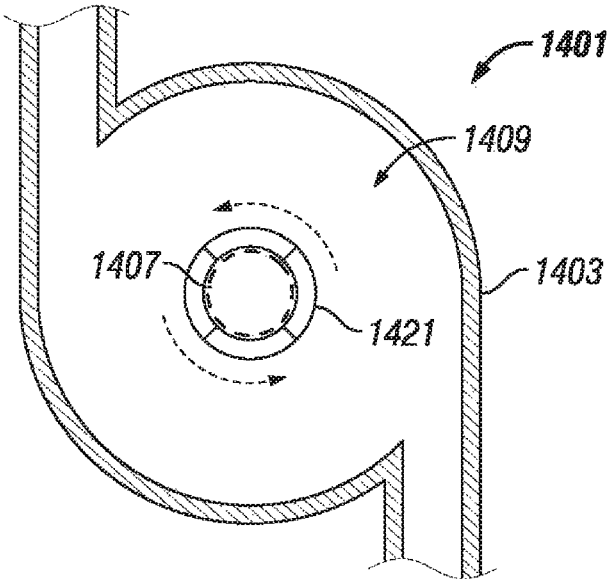

When a lower density fluid (e.g., gas or oil) enters the flow chamber 1403, such as shown in FIG. 14A, the flow restriction member 1409 may spin such that the segments 1421 move radially outward to create a space in between the segments 1421, thereby permitting fluid flow into the outlet 1407. When a higher density fluid (e.g., water) enters the flow chamber 1403, such as shown in FIG. 14B, the flow restriction member 1409 may segments 1421 move radially outward to create a space in between the segments 1421, thereby restricting or preventing fluid flow into the outlet 1407.

In addition to the embodiments described above, many examples of specific combinations are within the scope of the disclosure, some of which are detailed below:

Embodiment 1

A flow control system for use in a subterranean well, the system comprising:

- a flow chamber comprising an inlet and an outlet and configured to receive a fluid; and
- a flow restriction member positioned and movable within the flow chamber, the flow restriction member configured to restrict fluid flow from the inlet to the outlet of the flow chamber based upon a density of the fluid.

Embodiment 2

The flow control system of Embodiment 1, wherein the flow chamber is configured to induce fluid flow in a vortex about an axis within the flow chamber.

Embodiment 3

The flow control system of Embodiment 2, wherein the outlet is positioned in alignment with the axis and the flow restriction member is configured to restrict more fluid flow through the outlet for a higher density fluid than for a lower density fluid.

Embodiment 4

The flow control system of Embodiment 2, wherein the outlet is radially outward from the axis and the flow restriction member is configured to restrict more fluid flow through the outlet for a lower density fluid than for a higher density fluid.

Embodiment 5

The flow control system of Embodiment 2, wherein the inlet is positioned radially outward from the axis and at least partially tangent to the vortex within the flow chamber.

Embodiment 6

The flow control system of Embodiment 1, wherein the flow restriction member is configured to prevent fluid flow through the outlet for fluid having density above a predetermined amount.

Embodiment 7

The flow control system of Embodiment 1, wherein the flow restriction member is configured to prevent fluid flow through the outlet for fluid having density below a predetermined amount.

Embodiment 8

The flow control system of Embodiment 1, wherein the flow restriction member comprises a density that is substantially the same or less than that of water.

Embodiment 9

The flow control system of Embodiment 1, wherein the flow restriction member comprises a ball.

Embodiment 10

The flow control system of Embodiment 1, wherein the flow restriction member comprises a plurality of segments movably coupled to each other.

Embodiment 11

The flow control system of Embodiment 1, further comprising a degradable material positioned within the flow chamber with the flow restriction member at least partially positioned within the degradable material.

Embodiment 12

The flow control system of Embodiment 1, further comprising a plurality of flow restriction members, each comprising a different density, positioned within the flow chamber.

Embodiment 13

The flow control system of Embodiment 1, wherein the flow chamber comprises a lower friction surface portion and a higher friction surface portion with the higher friction surface portion positioned closer to the outlet than the lower friction surface portion.

Embodiment 14

A method for controlling fluid flow through a flow control system, comprising:

receiving fluid flow into an inlet of a flow chamber of the flow control system, thereby moving a flow restriction member within the flow chamber; and restricting fluid flow through an outlet of the flow chamber based upon a density of the fluid.

Embodiment 15

The method of Embodiment 14, wherein the moving the flow restriction member comprises rotating the flow restriction member about an axis within the flow chamber with a vortex of fluid flow.

Embodiment 16

The method of Embodiment 15, wherein the flow restriction member rotates closer to the axis for a higher density fluid than for a lower density fluid.

Embodiment 17

The method of Embodiment 15, wherein the outlet is positioned in alignment with the axis and the flow restriction member is configured to restrict more fluid flow through the outlet for a higher density fluid than for a lower density fluid.

Embodiment 18

A flow control system for use in a subterranean well, the system comprising:

a flow chamber comprising an inlet and an outlet and configured to induce fluid flow in a vortex shape about an axis within the flow chamber;

a flow restriction member positioned within the flow chamber and rotatable about the axis such that the flow restriction member rotates closer to the axis for a higher density fluid than for a lower density fluid.

Embodiment 19

The flow control system of Embodiment 18, wherein the flow restriction member configured to restrict fluid flow from the inlet to the outlet of the flow chamber based upon a density of the fluid.

Embodiment 20

The flow control system of Embodiment 18, wherein the flow chamber is configured to induce fluid flow in a vortex about an axis within the flow chamber.

One or more specific embodiments of the present disclosure have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

In the following discussion and in the claims, the articles "a," "an," and "the" are intended to mean that there are one or more of the elements. The terms "including," "comprising," and "having" and variations thereof are used in an open-ended fashion, and thus should be interpreted to mean "including, but not limited to . . . ." Also, any use of any form of the terms "connect," "engage," "couple," "attach," "mate," "mount," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. The use of "top," "bottom," "above," "below," "upper," "lower," "up," "down," "vertical," "horizontal," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A flow control system for use in a subterranean well, the system comprising:

a flow chamber comprising an inlet and an outlet, the flow chamber configured to receive a fluid and induce fluid flow in a vortex about an axis within the flow chamber, the inlet positioned radially outward from the axis and at least partially tangent to the vortex within the flow chamber; and a flow restriction member positioned and movable within the flow chamber, the flow restriction member configured to restrict fluid flow from the inlet to the outlet of the flow chamber based upon a density of the fluid.

2. The flow control system of claim 1, wherein the outlet is positioned in alignment with the axis and the flow restriction member is configured to restrict more fluid flow through the outlet for a higher density fluid than for a lower density fluid.

3. The flow control system of claim 1, wherein the outlet is radially outward from the axis and the flow restriction member is configured to restrict more fluid flow through the outlet for a lower density fluid than for a higher density fluid.

4. The flow control system of claim 1, wherein the flow restriction member is configured to prevent fluid flow through the outlet for fluid having density above a predetermined amount.

5. The flow control system of claim 1, wherein the flow restriction member is configured to prevent fluid flow through the outlet for fluid having density below a predetermined amount.

6. The flow control system of claim 1, wherein the flow restriction member comprises a density that is substantially the same or less than that of water.

7. The flow control system of claim 1, wherein the flow restriction member comprises a ball.

8. The flow control system of claim 1, wherein the flow restriction member comprises a plurality of segments movably coupled to each other.

9. The flow control system of claim 1, further comprising a degradable material positioned within the flow chamber with the flow restriction member at least partially positioned within the degradable material.

10. The flow control system of claim 1, further comprising a plurality of flow restriction members, each comprising a different density, positioned within the flow chamber.

11. The flow control system of claim 1, wherein the flow chamber comprises a lower friction surface portion and a higher friction surface portion with the higher friction surface portion positioned closer to the outlet than the lower friction surface portion.

12. A method for controlling fluid flow through a flow control system, comprising:

receiving fluid flow into an inlet of a flow chamber of the flow control system, thereby rotating a flow restriction member about an axis within the flow chamber with a vortex of fluid flow; and restricting fluid flow through an outlet of the flow chamber based upon a density of the fluid.

13. The method of claim 12, wherein the flow restriction member rotates closer to the axis for a higher density fluid than for a lower density fluid.

14. The method of claim 12, wherein the outlet is positioned in alignment with the axis and the flow restriction member is configured to restrict more fluid flow through the outlet for a higher density fluid than for a lower density fluid.

15. A flow control system for use in a subterranean well, the system comprising:

a flow chamber comprising an inlet and an outlet and configured to induce fluid flow in a vortex shape about an axis within the flow chamber;

a flow restriction member positioned within the flow chamber and rotatable about the axis such that the flow restriction member rotates closer to the axis for a higher density fluid than for a lower density fluid.

16. The flow control system of claim 15, wherein the flow restriction member configured to restrict fluid flow from the inlet to the outlet of the flow chamber based upon a density of the fluid.

17. The flow control system of claim 15, wherein the flow chamber is configured to induce fluid flow in a vortex about an axis within the flow chamber.

* * * * *